United States Patent [19]

Rice, Jr. et al.

[11] Patent Number: 4,697,519

[45] Date of Patent: Oct. 6, 1987

[54] SMART MINE

[75] Inventors: Joseph A. Rice, Jr., McKinney; Douglas D. McGregor, Plano; Forrest D. Colegrove, Dallas; Bela Marton, Allen, all of Tex.

[73] Assignee: Texas Instruments Incorporated, Dallas, Tex.

[21] Appl. No.: 762,480

[22] Filed: Aug. 5, 1985

[51] Int. Cl.[4] ..... F42B 22/04

[52] U.S. Cl. ..... 102/406; 102/417

[58] Field of Search ..... 102/411, 417, 418, 419, 102/406

[56] References Cited

U.S. PATENT DOCUMENTS

| | | | |
|---|---|---|---|
| 2,966,853 | 1/1961 | Gilfillan, Jr. et al. | 102/417 |
| 3,135,199 | 6/1964 | Brown | 102/417 |
| 3,206,671 | 9/1965 | Colegrove, Jr. et al. | 324/304 |
| 4,003,291 | 1/1977 | Vass et al. | 102/411 |
| 4,395,952 | 8/1983 | Hickey | 102/411 |
| 4,566,367 | 1/1986 | Hickey | 102/411 |
| 4,567,439 | 1/1986 | McGregor | 324/304 |
| 4,586,421 | 5/1986 | Hickey et al. | 102/411 |

*Primary Examiner*—Charles T. Jordan

*Attorney, Agent, or Firm*—Melvin Sharp; James T. Comfort; Leo N. Heiting

[57] ABSTRACT

A smart mine includes a pair of $He^3$ magnetic sensors exteriorly connected to a head compartment of a mine housing. A torpedo compartment for housing a torpedo completes the mine housing. The head compartment contains the sensor support electronics which includes a phase locked loop means having a pair of digital phase locked loops connected between the sensors and a difference circuit whereby a difference signal representative of the difference between the pair of $He^3$ magnetic sensors is produced for processing in a signal processor for determining the presence of large ferromagnetic bodies and producing a torpedo firing signal.

7 Claims, 5 Drawing Figures

SMART MINE

The Government has rights in this invention pursuant to Contract No. 60291-80-0161 awarded by the Navy Department.

BACKGROUND OF THE INVENTION

This invention relates to smart mines and more particularly to a mine utilizing $He^3$ magnetic sensors.

This invention relates to U.S. patent application Ser. No. 762,478, Filed Aug. 5, 1985 For "Improved Buoy Detection System Using $He^3$ Magnetic Sensor" (TI-11182) and to U.S. patent application Ser. No. 762,477, Filed Aug. 5, 1985 For "Remote Magnetic Field Monitoring System Using $He^3$ Sensor Array" (TI-11183).

Prior art "Smart Mines" have utilized acoustic sensors to detect the presence of ships and submarines prior to the launch of a homing torpedo encapsulated in the mine. The detection effectiveness of acoustic sensors is decreasing owing to the quieting of ships including submarines.

SUMMARY OF THE INVENTION

Accordingly it is an object of the invention to enhance operational effectiveness of "Smart Mines".

Another object of the invention is to provide a "Smart Mine" having increased target detection or tracking or both capability.

Briefly stated the invention comprises incorporation of $He^3$ magnetic sensors either to the exclusion of acoustic sensors or in addition to the acoustic sensors. The $He^3$ magnetic sensor is particularly suited owing to its sensitivity at low frequencies, size, low power consumption and low cost in quantity production. Further, the $He^3$ sensor has a higher sensitivity than other low power magnetometers and thus provides longer range.

BRIEF DESCRIPTION OF THE DRAWINGS

Other objects and features of the invention will become more readily apparent from the following detailed description of the invention when read in conjunction with the accompanying drawings in which.

DESCRIPTION OF THE PREFERRED EMBODIMENT

Figure 1B:
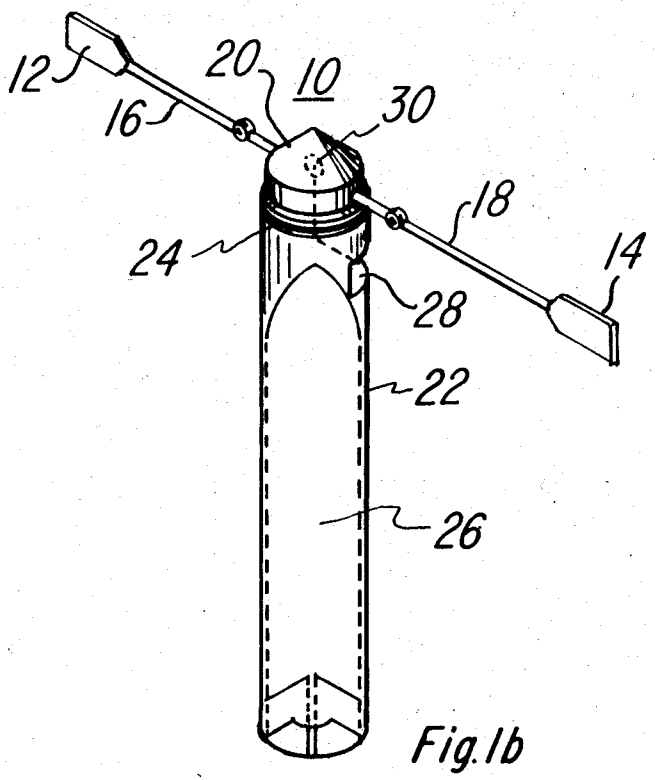
FIGS. 1*a* and 1*b* are isometric views of the mine in the non-deployed state and in the deployed state, respectively.
Figure 1A:
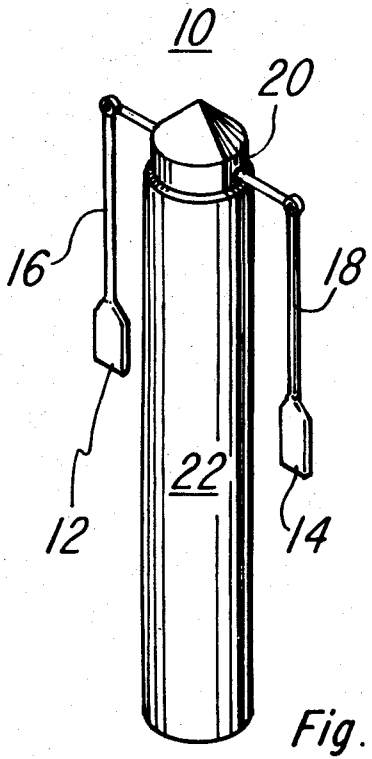

Referring now to FIGS. 1*a* and 1*b*, the $He^3$ magnetic sensor mine 10 includes a gradiometer having a pair of shielded sensors 12 and 14 pivotally connected through tubular aluminum rods 16 and 18 to the head 20 and two digital phase locked loop frequency discriminators. The head is removably fixed to the body 22 of the mine by a spring 24 mounted between the head 20 and the body 22. The body 22 of the mine is, for example, a torpedo tube for housing a torpedo 26. The body includes a port with a removable cover 28 attached to a motor 30 mounted in the head 20. In operation the body is filled with air and water pressure assists in maintaining the head in place with the spring 24 compressed. When the mine is initialized for firing, the motor 30 removes the port cover to flood the tube 22; this equalizes the pressure and the spring 24 removes the head 20 for torpedo firing. Sensors 12 and 14 include split spherical containers made of fiberglass mounted inside polyethylene shells which are sealed with a clamped O-ring. The aluminum arms 16 and 18 are potted into the shells and connect the sensor heads to the sensor support electronics mounted in the head of the mine.

Figure 2:
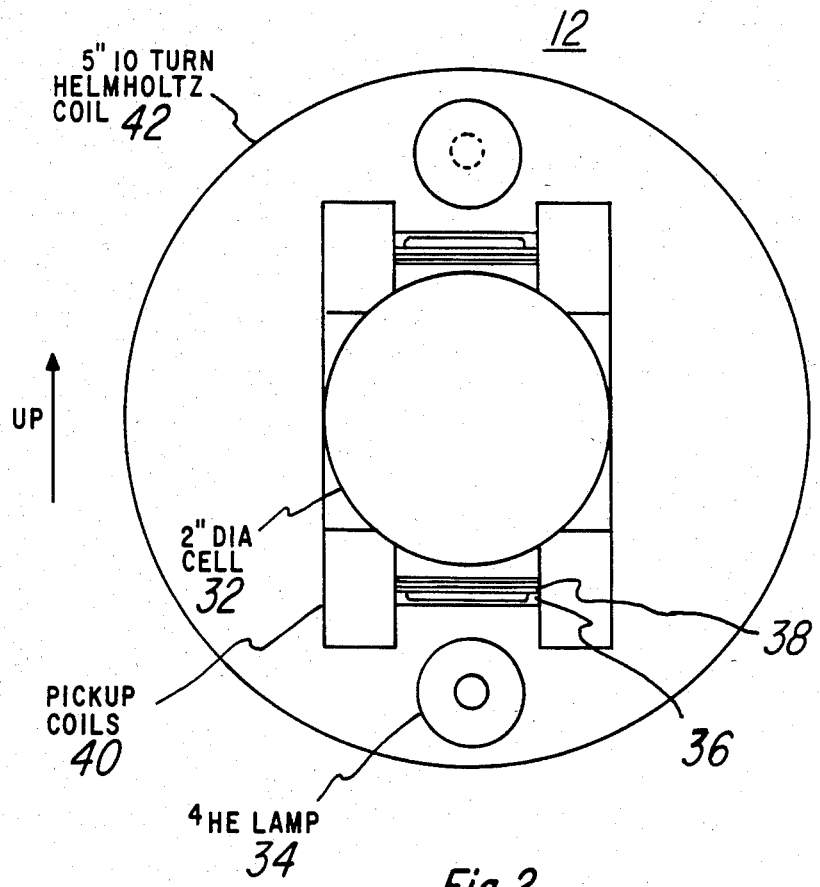
FIG. 2 is a plan view of the $He^3$ magnetometer constituting sensors for the mine.

The $He^3$ magnetometers or sensors 12 and 14 (FIG. 2) are those of U.S. Pat. No. 3,206,671 issued Sept. 14, 1965 to Texas Instruments Incorporated, assignee, as improved by the improvement of U.S. Pat. No. 4,567,439 filed Sept. 23, 1983 (TI-9233) assigned to Texas Instruments Incorporated. As the sensors are identical in construction only one need be described. The sensor 12 (FIG. 2) includes an $He^3$ cell 32, an $He^4$ lamp 34, Fresnel lens 36 and polarizer 38, pickup coils 40 and Helmholtz (moment rotation) coils 42.

The $He^3$ cell 32 is either a spherical or cylindrical glass cell containing a working substance ($He^3$) under a pressure of about 1 to 10 Torr. In the cell 32 $He^3$ atoms are excited to a metastable state by an electric discharge generated in the cell by either a 50 MHz or 100 MHz ignition oscillator of the sensor support electronics hereinafter described.

The $He^4$ lamp 34 radiates infrared spectral lines in response to a 50 Mhz lamp exciter oscillator of the sensor support electronics. The Fresnel lens 36 collimates the the radiation from the radiant electric discharge and the polarizer 38 circularly polarizes the collimated radiation. Thus, the polarized radiation is directed through the cell where it interacts with the metastable $He^3$ atoms to magnetize the $He^3$ atoms in a direction parallel to the direction of the ambient magnetic field (H).

After the cell magnetization has been established parallel to the Earth's field direction and the electric discharges of the lamp and cell extinguished, an oscillatory magnetic field is established normal to the direction of the ambient magnetic field by connecting the Helmholtz coils 42 to a frequency synthesizer of the sensor support electronics. The scanning frequency synthesizer scans through a frequency range containing the free precession frequency.

Free precession of the cell magnetization in the Earth's magnetic field then begins with the lamp, cell and frequency synthesizer power off and lasts more than 10 hours. The pickup coils 40 generate an alternating current (a.c.) induced therein by the magnetic field associated with the rotation of the cell magnetization. Those persons skilled in the art desiring more information about the sensor are referred to the above mentioned references.

Figure 3:
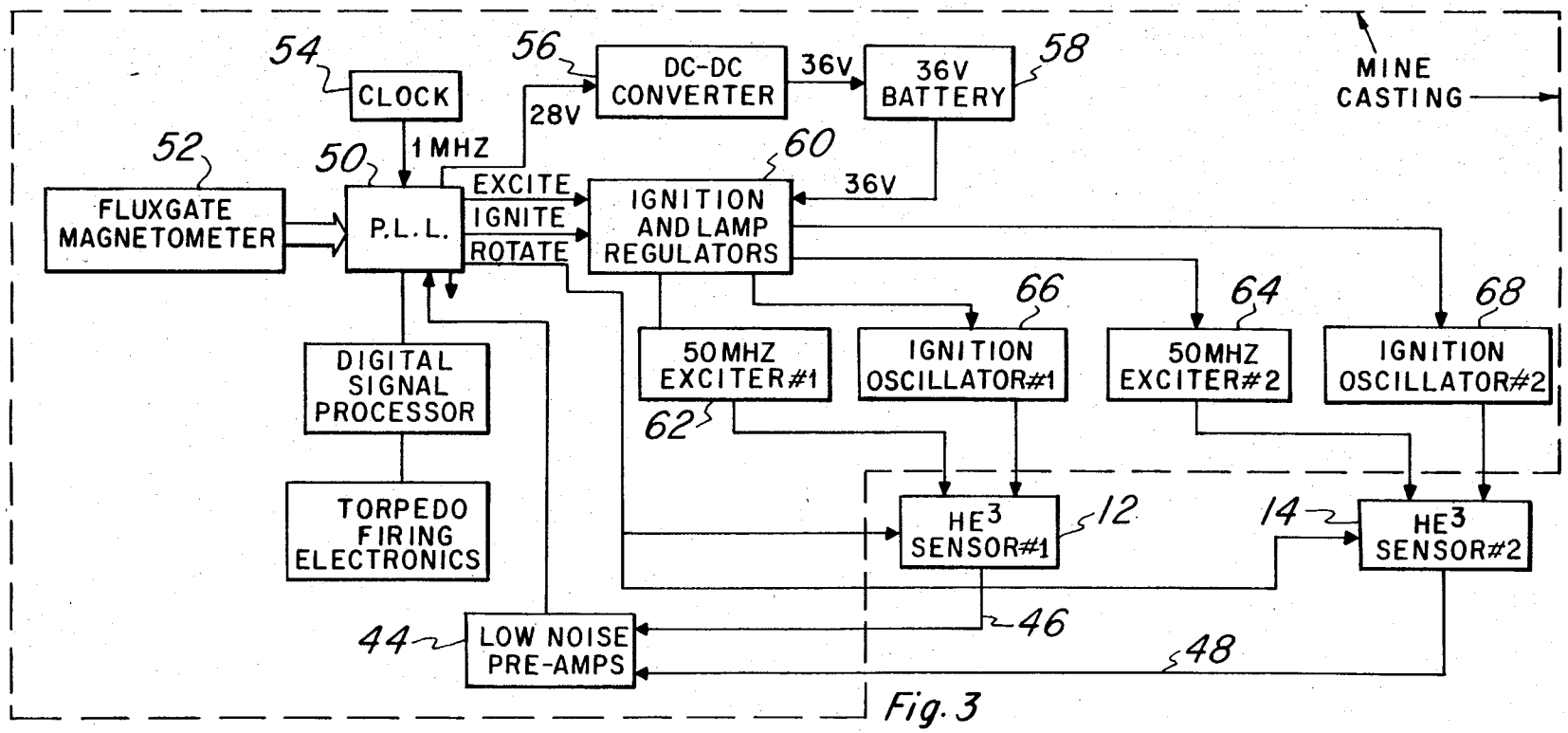
FIG. 3 is a block diagram of the sensor electronics and showing the relationship of the electronics and the sensors.

Referring now to FIG. 3, the sensor support electronics includes low noise preamplifiers 44 connected by leads 46 and 48, respectively, to $He^3$ sensors 12 and 14. The preamplifiers 44 are connected to digital phase locked loop 50. The phase locked loop 50 has inputs connected to a fluxgate magnetometer 52 and a one MHz clock 54. The phase locked loop 50 has output terminals including a 28 V power supply connected to a DC-DC converter 56 for converting the 28 V to a 36 V power source connected to a 36 V battery 58. Other output terminals connect excitation and ignition signals to ignition and lamp regulators 60, and rotate signals to the sensors 12 and 14. The ignition and lamp regulators are powered by the battery 58 and regulate power to the 50 MHZ exciter oscillators 62 and 64, and to the ignition oscillators 66 and 68. The exciter 62 and ignition oscillator 66 are connected to sensor 12 and exciter 64 and ignition oscillator 68 are connected to sensor 14.

Figure 4:
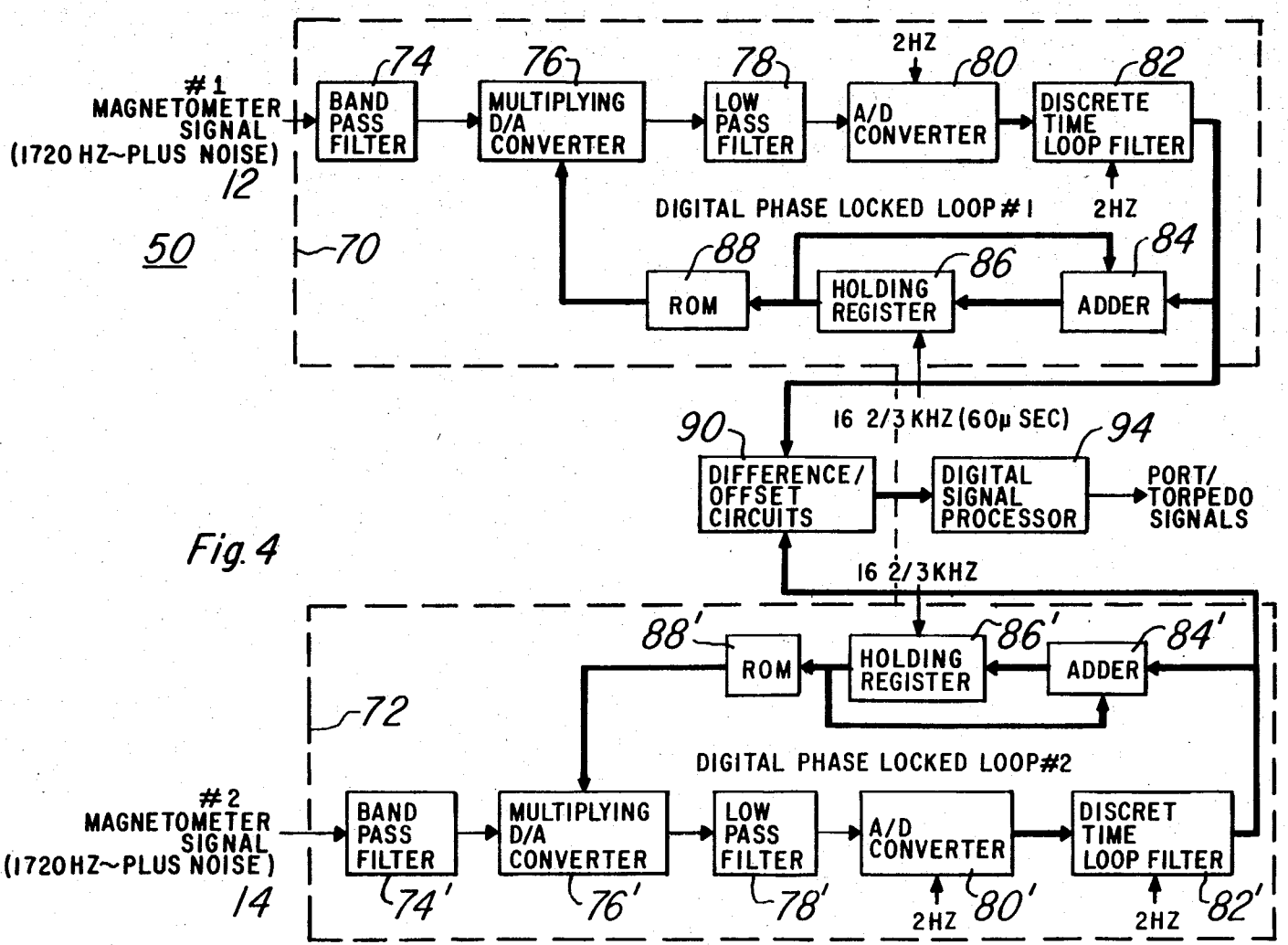
FIG. 4 is a block diagram of the digital phase locked loops frequency synthesizers for the sensors.

The digital phase locked loop 50 includes a pair of loops 70 and 72 (FIG. 4) one for each sensor 12 and 14. As each loop is identical only one need be described. The other loop elements will be designated with primed numbers.

The phase locked loop 70 includes a band pass filter 74 connected to the sensor 12 for bandpass filtering (700 to 3000 Hz) the signal from its pickup coils. A multiplying D/A converter 76 is connected to the bandpass filter 74; the D/A converter serves as a phase detector. A low pass anti-aliasing filter 78 is connected to the D/A converter for passing the analog signal into an analog-digital converter 80 with a 2 Hz data rate. A discrete time loop filter 82 (digital filter) determines the performance characteristics of the phase locked loop. The natural frequency of the loop is 0.03 Hz with a nominal damping factor of 0.8. The digital filter acts as an integrator with phase lead correction. The output of the filter goes into an adder 84. A holding register 86 is connected to the adder; together they form an automatically rezeroing ramp generator with the instantaneous slope controlled by the input to the adder. A read only memory (ROM) 88 is connected to the holding register 86. The adder, holding register and ROM form a digital VCO for the multiplying D/A converter. The digital word coming out of the holding register is essentially the phase of the digital VCO. The ROM is programmed to perform the cosine function of the phase which goes into the multiplying D/A converter 76. The digital signal corresponding to the magnetic sensor 12 signal frequency constitutes the input to the adder 84.

Digital phase locked loop 72 follows the signal for the magnetic sensor 14. Difference/offset circuits 90 receive the digital signals corresponding to the magnetometers signal frequencies and output the difference as a digital signal. The digital signals represent the output of the gradiometer.

A signal processor 94 is connected to the difference/-offset circuits for comparing the filtered output of the gradiometer a threshold (either a preselected value or a calculated value based on the gradiometer) and when the threshold is exceeded generating a port release signal to flood the torpedo tube to equalize the pressure for the spring to remove the mine body head 20.

Although a single embodiment of the invention has been described, it will be apparent to a person skilled in the art that various modifications to the details of construction shown and described may be made without departing from the scope of this invention.

What is claimed is:

1. An anti-submarine warfare (ASW) mine comprising;

a. a housing including a torpedo compartment and a head compartment;

b. said torpedo compartment including a port having a removable cover, c. a port cover removing means mounted in said housing, d. said port cover removing means operatively connected to the port cover for removing said port cover and flooding the torpedo compartment, and e. a spring between said torpedo compartment and head compartment for selectively separating the head compartment from said torpedo compartment, f. sensor support electronics operatively mounted in the head compartment; and g. a plurality of magnetic sensor means exteriorly attached to the housing and operatively connected to the support electronics for sensing the Earth's magnetic field, whereby the sensor support electronics controls the operation of the magnetic sensor means, detects variations in the Earth's magnetic field resulting from the presence of ferromagnetic bodies and produces mine influence signals.

2. An ASW mine according to claim 1 wherein the plurality of magnetic sensor means includes a plurality of sensor pods, a corresponding plurality of $He^3$ magnetic sensors mounted in each pod, a corresponding plurality of rods interconnecting the pods and head compartment, and a plurality of electrical cables interconnecting the plurality of sensors to the sensor electronics.

3. An ASW mine according to claim 2 wherein each $He^3$ sensor includes a cell containing $He^3$ atoms, some of which are temporarily excited to a metastable state, a $He^4$ lamp, lens and polarizer forming an optical path to the cell for producing collimated, circular polarized electromagnetic radiation energy for magnetizing the $He^3$ atoms in the cell in a direction parallel to the ambient magnetic field, a Helmholtz coil in operative association with the cell for establishing an oscillatory magnetic field normal to that of the ambient magnetic field, and pickup coils operative during free precession of the cell for generating a.c. induced therein by the magnetic field associated with the rotation of the cell magnetization.

4. An ASW mine according to claim 3 wherein the sensor support electronics includes a phase locked loop and support electronics means for providing excitation, ignition and rotation signals, an exciter oscillator and an ignition oscillator for each of the plurality of $He^3$ sensors, the ignition oscillator operatively connected to the phase locked loop and support electronics means for receiving the excitation signal and to the $He^3$ cell and $He^4$ lamp for exciting the cell and preparing the lamp for ignition, and the exciter oscillator operatively connected to the phase locked loop and support means for receiving the ignition signal and to the lamp for ignition, a phase locked loop frequency discriminator of the phase locked loop and support electronics means operatively connected to the Helmholtz coil of the sensor for providing the rotation signals to the coil for establishing the oscillating magnetic field normal to the ambient magnetic field, and preamplifiers operatively connected to the pickup coils for amplifying the magnetic field associated with the precission of the cell atoms for the phase locked loop and support electronics means, a fluxgate magnetometer for determining the motion attitude of the housing, and a signal processor operatively connected to the fluxgate magnetometer and phase locked loop of the phase locked loop and support electronics means for detecting the presence of ferromagnetic bodies and generating mine operating signals.

5. An ASW mine according to claim 4 wherein the phase locked loop and support electronics means includes a plurality of digital phase locked loop circuits corresponding to the plurality of magnetic sensors, said phase locked loop circuits producing digital signals corresponding to the magnetometer signal frequencies, a difference circuit operatively connected to the outputs of the phase locked loops and outputting the difference as a digital signal for the signal processor.

6. An ASW mine according to claim 5 wherein each digital phase locked loop includes a bandpass filter operatively connected to a sensor for removing noise signals, a multiplying digital to analog (D/A) converter operatively connected to the bandpass filter and digital VCO for phase detection, an anti-aliasing filter operatively connected to the multiplying D/A converter, an analog to digital (A/D) converter operatively connected to the anti-aliasing filter, a digital loop filter operatively connected to the A/D converter for integrating the signals with phase lead correction and determining the performance characteristics of the phase locked loop, and said digital VCO comprising an adder operatively connected to the digital filter, a holding register operatively connected to the adder and a read only memory (ROM) operatively connected to the holding register, said adder and holding register coacting to form an automatically rezeroing ramp generator with instantaneous slope controlled by the adder for producing a digital word representative of the phase of the digital VCO and the ROM for performing the cosine phase function for the multiplying D/A converter to complete the phase locked loop.

7. An ASW mine comprising a mine housing, a gradiometer operatively connected to the mine housing for generating magnetometer frequencies, said gradiometer includes two sensors and a digital phase locked loop frequency discriminator, a difference means operatively connected to the gradiometer for producing a difference signal representative of the frequency difference between the magnetometer frequencies of the gradiometer, and a signal processor operatively connected to the difference means for detecting the presence of a ferromagnetic body and generating a trigger to a mine torpedo.

* * * * *